United States Patent [19]

Halm et al.

[11] Patent Number: 4,756,442

[45] Date of Patent: Jul. 12, 1988

[54] CONTAINER CAP

[75] Inventors: Hans Halm, Herne; Guenter Schwerdt, Buehl, both of Fed. Rep. of Germany

[73] Assignee: Lingner & Fischer GmbH, Fed. Rep. of Germany

[21] Appl. No.: 64,075

[22] Filed: Jun. 18, 1987

[30] Foreign Application Priority Data

Jun. 20, 1986 [GB] United Kingdom ..... 8615169

[51] Int. Cl.[4] ..... B65D 1/02

[52] U.S. Cl. ..... 220/254; 215/306; 220/339; 220/375; 222/509

[58] Field of Search ..... 215/306; 220/254, 375, 220/339; 222/465.1, 469, 509, 563

[56] References Cited

U.S. PATENT DOCUMENTS 2,977,973 4/1961 Chakine ..... 215/306 X
4,121,731 10/1978 Okerstrom ..... 222/509 X
4,335,770 6/1982 Kulle et al. ..... 220/339 X
4,513,870 4/1985 Zaltsman ..... 215/306 X
4,640,493 2/1987 Dudzik ..... 222/509 X

*Primary Examiner*—Stephen Marcus
*Assistant Examiner*—Nova Stucker
*Attorney, Agent, or Firm*—Jacobs & Jacobs

[57] ABSTRACT

A cap 2 for a dispensing container 1 for a liquid, has an outlet orifice 9 sealable by a plug 15 formed on a flexible band 11 which is hingedly attached 16, 20 to the cap and which, when the plug 15 is removed from the orifice 9, forms a hanging support for the container 1, the band lying in the same vertical plane in both the open and closed positions.

The cap is useful for containers for shower gels and the like, where it is necessary to hang the container from a support during use.

The cap can also be adapted to contain two orifices each serving a separate compartment of a twin-compartment pack.

10 Claims, 4 Drawing Sheets

CONTAINER CAP

Figure 1:
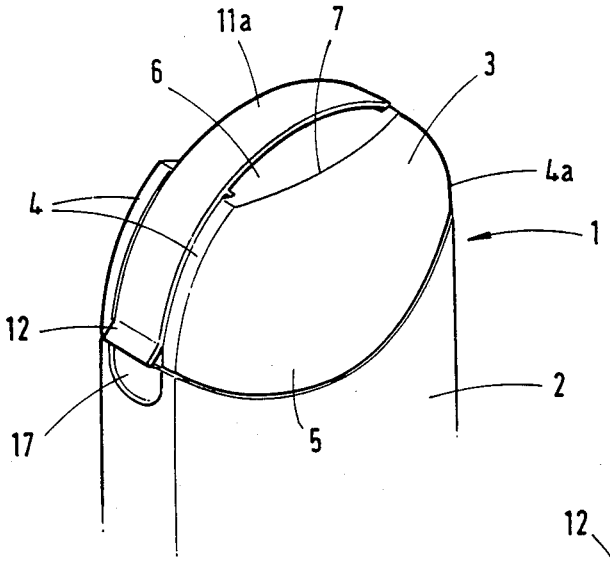

The present invention relates to a cap for a container for dispensing liquids, and in particular to a cap for a container for dispensing shower gel, shampoo, and like products, and to a cap for a twin-pack container for dispensing, for example, two-component glues.

It is well known to provide plastics shower gel containers with attached loops of string, rope or plastics material to hang the container from a support during use. Many of these designs are aesthetically unpleasing; in some cases the loops can be a nuisance during storage of the container; and in some cases the loops can break or become detached with repeated use.

British Patent Specification No. 1 592 560 (S. M. Libit) describes a dispensing closure for a container for liquids, comprising a cap with a puncturable or rupturable central orifice and a sharp puncturing member carried as a flexible arm or bail. The puncturing member could also serve as a plug for the orifice, but only with the arm or bail flexed out of its natural position. Also in certain embodiments the arm might be able to also serve as a hanging support, but again only when distorted from its natural position and in a somewhat inelegant and awkward manner.

A cap for a dispensing container for shower gels and other liquids has now been designed in which a hanging loop for the container is 'built-in' and is functionally associated with the closure for the container contents. The dispensing container cap according to the invention gives an aesthetically pleasing container with a convenient arrangement for hanging the container from a support during use. It also provides a secure closure for an outlet orifice in the cap and can be arranged to provide closures for two separate outlet orifices in a twin-compartment container.

According to the present invention there is provided a cap for a dispensing container for a liquid, the cap having an outlet orifice for the liquid and a removable closure for the outlet, the closure comprising a flexible band carrying a plug for sealing the outlet orifice, each end of the band being flexibly attached to the cap, and the band being constructed to form a hanging support for the container when the plug is removed from the orifice, and being arranged to lie in substantially the same plane both when the orifice is closed and when the orifice is open.

The cap according to the invention may contain two separate compartments, each communicable with a respective compartment in the container and each provided with an outlet orifice, with the flexible band carrying a plug for sealing each outlet orifice. Advantageously, the flexible band is so arranged that either plug is removable from its respective orifice while the other orifice remains sealed by its plug. Also, advantageously the flexible band forms a hanging support for the container when only one plug is removed from its orifice.

In the cap according to the invention, each end of the flexible band is preferably flexibly attached to the cap through a hinge or other pivot means. Suitably, the or each plug is formed on a portion or respective portion of the band which is hinged at each end of the said portion, at least one of the hinged ends of the said portion being located between the ends of the band attached to the cap.

The or each plug-carrying portion of the band is advantageously concealed by another portion of the band when the outlet orifice or the respective outlet orifice is closed, and is revealed when the plug is removed from the said orifice. One end of the or each plug-carrying portion is preferably directly attached to the cap, while the other end is hingedly attached to the remainder of the band, the two ends of the or each plug-carrying portion being arranged to pivot about the respective hinge connections in the same angular or arcuate direction at the same time.

The flexible band is preferably constructed of resilient synthetic plastics material, and is preferably connected directly to a container cap of the same material. The hinge connections can be constructed in a known manner by reducing the thickness of the plastics material at the joints between the band and the cap, and any additional hinges along the length of the band can be similarly constructed.

The flexible band may be arranged to be resiliently biased toward the open position with a snap-fit engagement to retain it in the closed position. In another arrangement, the flexible band may move through an intermediate resistance position, being resiliently biased toward the open position on one side of the intermediate resistance position, and toward the closed position on the other side of the said intermediate position. It may additionally include a snap-fit engagement to retain it securely in the closed position.

In a particularly preferred embodiment of the cap according to the invention, a portion (especially a major portion) of the flexible band is arcuate. The arcuate portion may be resiliently deformable to provide resilient bias. The arcuate portion may be resiliently biased to return to an arc of predetermined radius, but may be resiliently deformable to an arc of greater or smaller radius, returning to the predetermined radius on release of the deforming pressure. Preferably, the arcuate portion is so arranged as to bias the flexible band toward the open position or toward the closed position on respective sides of an intermediate deformed position.

Advantageously, the arcuate portion of the band conceals the plug-carrying portion of the band in the closed position. Also advantageously the end of the plug-carrying portion remote from the cap is hingedly attached to one end of the arcuate portion. The other end of the arcuate portion may be hingedly attached either directly to the cap, or to one end of a straight portion of the band the other end of which is hingedly attached to the cap.

In such an arrangement, on lifting the end of the arcuate portion attached to the plug-carrying portion from the closed position, the arcuate portion deforms to an arc of greater radius enabling the plug-carrying portion to be hinged away from the orifice, after which it resiliently returns to its original radius and the plug-carrying portion remains open as an extension of one end of the arcuate portion. Where present, the said straight portion also forms an extension of the arcuate portion at its other end. Thus, in the open position, the several portions of the flexible band together constitute a loop for hanging the container.

In a particularly preferred form of the two-compartment cap according to the invention, the flexible band comprises an arcuate portion interposed between two plug-carrying portions, both plug-carrying portions being concealed by the arcuate portion when both orifices are closed, and each plug-carrying portion being revealed when the respective orifice is open. Each plug-carrying portion is suitably flexibly attached at one end to the cap with its other end being flexibly attached to one end of the arcuate portion. The two ends of each plug-carrying portion are suitably arranged to pivot about the respective flexible attachments in the same angular or arcuate direction at the same time.

The container cap according to the invention may be formed integrally with the container body or, preferably, may be formed separately and may be attached thereto by, for example, push-fit, snap-fit, screw-fit or adhesive. The flexible band is preferably formed integrally with the remainder of the cap, but it may alternatively be formed separately and be attached by interlocking fit and/or by adhesive. The container cap may conveniently be manufactured by conventional plastics moulding techniques.

Figure 2:
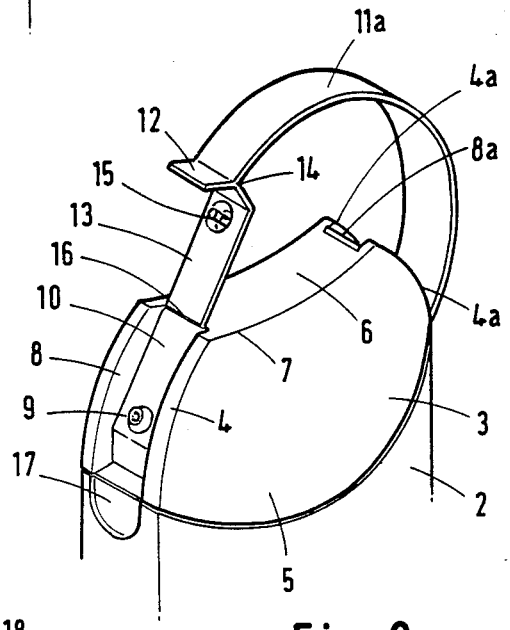
Figure 3:
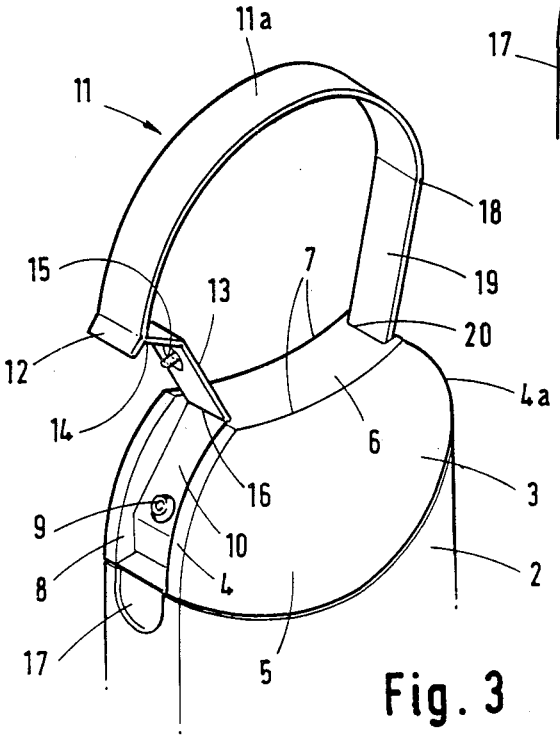
Figure 4:
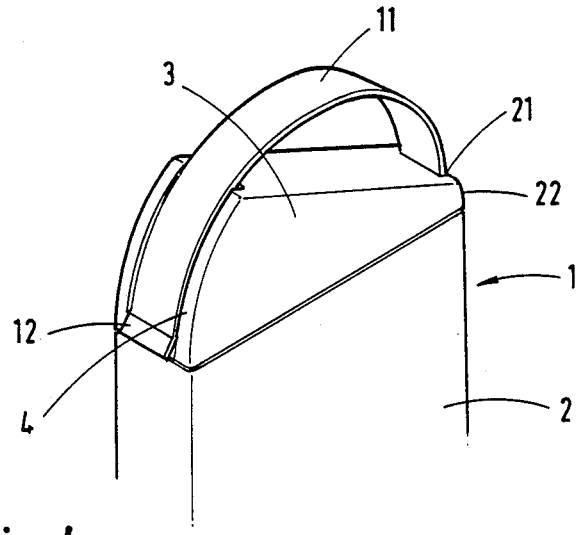
Figure 5:
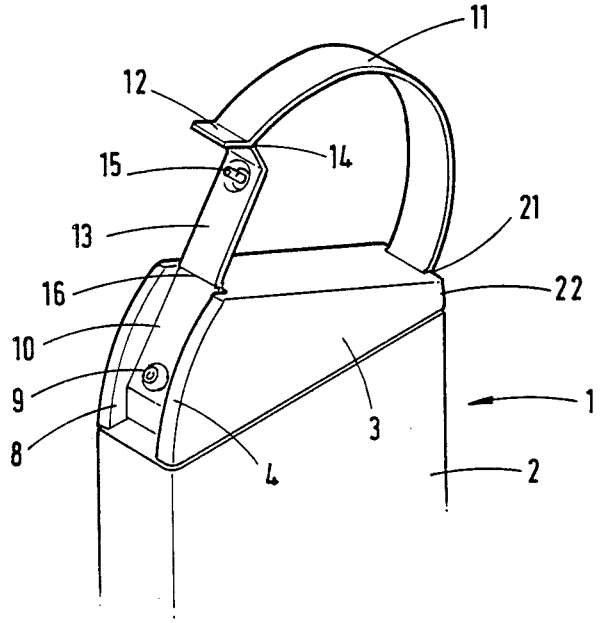
Figure 6:
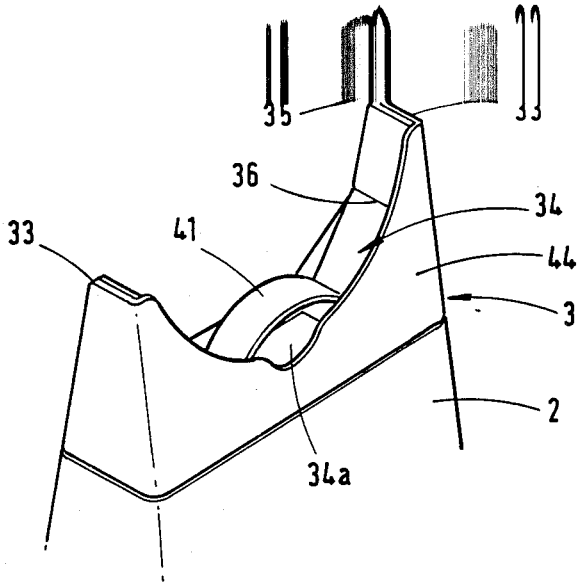
Figure 7:
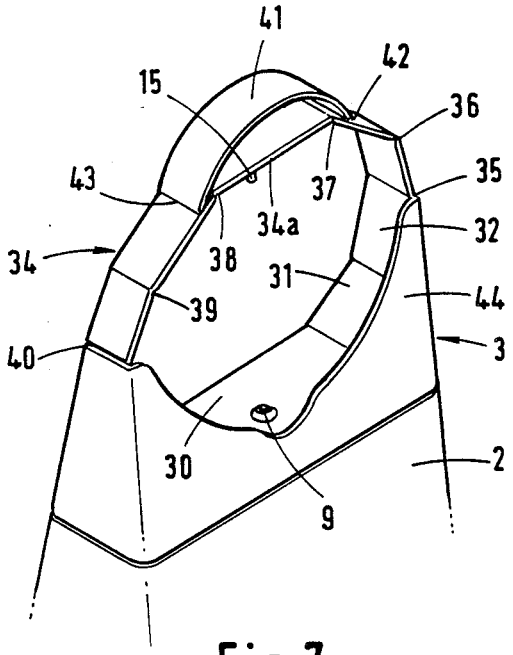
Figure 8:
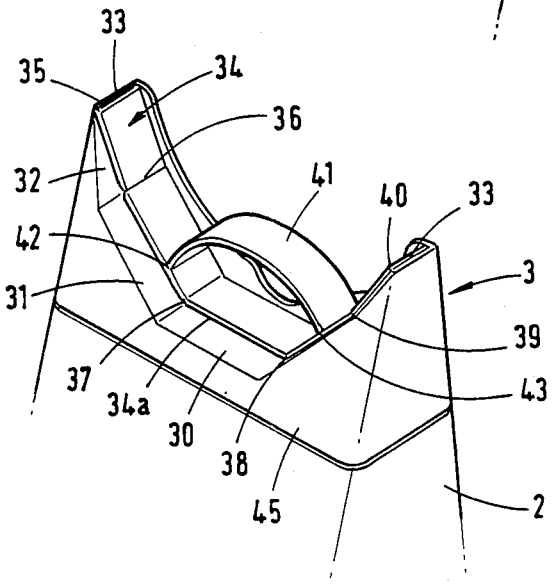
Figure 9:
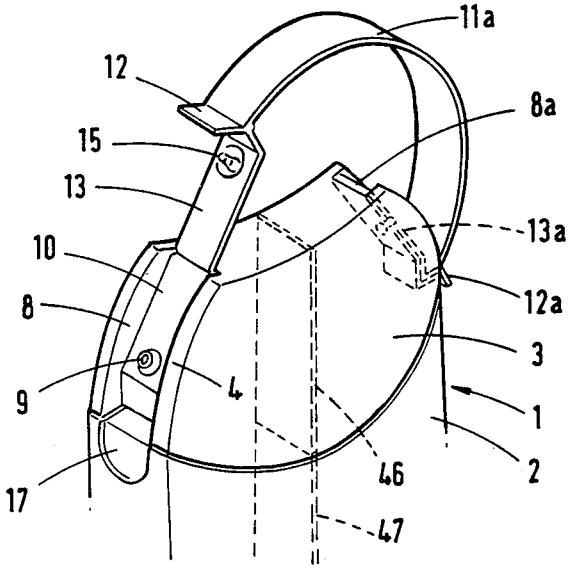
Figure 10:
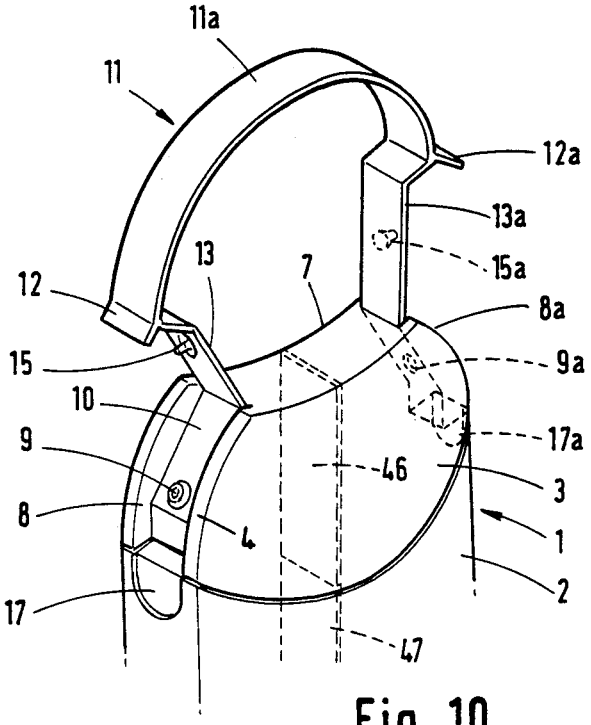

Various forms of container caps according to the invention will now be described, by way of example only, with reference to the accompanying drawings, in which like numerals denote like parts throughout the several embodiments, and in which:

FIG. 1 is a perspective view of a first embodiment of a container cap according to the invention with the flexible band closure in the closed position;

FIG. 2 is a perspective view of the container cap shown in FIG. 1 but with the closure in an intermediate open position; FIG. 3 is a perspective view of the container cap shown in FIG. 1 with the closure in the fully open position; FIG. 4 is a perspective view of a second embodiment of a container cap according to the invention with its flexible band closure in the closed position; FIG. 5 is a perspective view of the container cap shown in FIG. 4 with the closure in the fully open position; FIG. 6 is a perspective view of a third embodiment of a container cap according to the invention with its flexible band closure in the closed position; FIG. 7 is a perspective view of the container cap shown in FIG. 6 with the closure in the fully open position; FIG. 8 is a rear perspective view of the container cap shown in FIG. 6 with the closure in the closed position; FIG. 9 is a perspective view of a fourth embodiment of a container cap according to the invention, for use on a twin-compartment container, showing the closure with one compartment open; and FIG. 10 is a perspective view of the container cap shown in FIG. 9, with both compartments open.

A first embodiment of a container cap according to the invention is shown in FIGS. 1 to 3. A hollow container 1 for a shampoo, shower gel, or like product has a body 2 of resilient, synthetic plastics material, such as polyethylene, and a cap 3 made of similar material and of similar cross sectional configuration, the cap 3 being a tight push-fit onto the body 2 so as to provide an overall smooth exterior to the container 1. During manufacture, the body 2 will normally be filled with a viscous shower gel, shampoo, or like produuct prior to the cap 3 being placed in position. The cap 3 has a pair of convexly curved end walls 4, 4*a*, a pair of curved side walls 5, and a concavely curved top wall 6 having parallel, curved outer edges 7. Each end wall 4, 4*a* includes a channel 8, 8*a* extending the full height of each end wall 4, 4*a*, one of which channels, viz. channel 8, houses an outlet orifice 9 projecting from an upwardly sloping channel floor 10.

The cap 3 includes a flexible band 11 of a resilient plastics material hingedly attached to the remainder of the cap at the top of each channel 8, 8*a* (as can best be seen in the open configuration shown in FIG. 3) by hinges 16, 20. The flexible band 11 comprises, as a major part thereof, an arcuate portion 11*a*, one end of which is hingedly attached to a closure portion 13, through hinge 14, and the other end of which is hingedly attached to a straight portion 19, through hinge 18. The ends of the closure portion 13 and the straight portion 19 remote from the arcuate portion 11*a* are attached to the remainder of the cap through the hinges 16, 20 respectively.

The width of the flexible band 11 corresponds to the width of the channels 8, 8*a*. The closure portion 13 is shaped to complement the shape of the floor 10 of the channel 8, and it carries a projecting plug 15 for snap-fit engagement into the orifice 9 to seal the container 1. The end of the arcuate portion 11*a* adjacent the closure portion 13 and the hinge 14 carries an out-turned lip 12.

In the closed configuration of the cap 3, as shown in FIG. 1, the closure portion 13 of the flexible band 11 lies within the channel 8 with the plug 15 sitting in the orifice 9, and the straight portion 19 lies within the channel 8*a*. The two ends of the arcuate portion 11*a* also lie within the channels 8, 8*a* respectively, overlying the closure portion 13 and the straight portion 19, such that the top surface of each end of the arcuate portion 11*a* lies tlush with the end walls 4, 4*a* respectively. The lip 12 projects outwardly immediately above a shallow recess 17 in the 2 body 2 of the container 1. The arcuate portion 11*a* also overlies the curved top wall 6 leaving a gap between the band 11 and the top wall 6.

The flexible band 11 is retained in that closed configuration both by the snap-fit engagement of the plug 15 in the orifice 9, and also by the resilient bias of the arcuate portion 11*a*.

In order to open the container, a finger or thumb is pressed upwardly against the lift 12, to lift the band 11 out of the channel 8 and away from the outlet orifice 9. The shallow recess 17 assists in this action. As a result of the upward force, the closure portion 13 pivots in a clockwise direction (as viewed in FIGS. 1–3) about hinge 16 and also in a clockwise direction about hinge 14, resulting in the removal of the plug 15 from the orifice 9, and in the removal of the arcuate portion 11*a* and the closure portion 13 from the channel 8. During this movement, the other end of the arcuate portion 11*a* pivots about the hinge 18 to bring the cap into an intermediate open position, as shown in FIG. 2, wherein the closure portion 13 no longer underlies the arcuate portion 11*a* but constitutes an extension thereof.

During the course of that opening movement, the arcuate portion 11*a* of the flexible band is forced against its resilient bias through an intermediate resistance configuration (intermediate between the configurations shown in FIGS. 1 and 2) wherein the arcuate portion 11*a* is in a somewhat flattened arcuate shape. Having moved through that position, the arcuate portion 11*a* regains its original arcuate form, as a result of the resilience of the material, thus biasing the band toward the open configuration.

After reaching the position shown in FIG. 2, the band 11 may next be lifted, for example between finger and thumb, so that the straight portion 19 is pivoted out of channel 8*a*, about hinges 18 and 20, to take up the fully open configuration, as shown in FIG. 3, in which the straight portion 19 also constitutes an extension of the arcuate portion 11*a*. The entire band 11, comprising portions 11*a*, 13 and 19, then forms a loop by which the container 1 may be hung from a convenient support, such as a hook or knob, thereby providing maximum ease of use.

In order to close the orifice 9, the above described opening sequence is simply reversed to return to the closed configuration as shown in FIG. 1, with the arcuate portion 11*a* again passing through an intermediate resistance position in which it is somewhat flattened. The snap-fit engagement of the plug 15 in the orifice 9 and the resilience or the arcuate portion 11*a* are sufficient to maintain the container securely closed until it is desired to re-open it.

Throughout the entire opening and closing sequences, the flexible band 11 remains in a single vertical plane.

A second embodiment of a container cap according to the invention is shown in FIGS. 4 and 5. This second embodiment is similar to that shown in FIGS. 1 to 3, and it operates in a similar matter, the major differences reside in the shape of the cap 3, which is substantially wedge-shaped, and in the omission of the straight portion 19 ot the flexible band 11. In this embodiment, the arcuate portion 11*a* is hingedly attached directly to the remainder of the cap 3 througn hinge 21 at the apex 22 of the wedge-shaped cap 3. In other respects, the arrangement of the closure portion 13, the end wall 4, the channel 8, the outlet orifice 9, the plug 15 and associated features is identical to that of FIGS. 1 to 3, and the opening and closing operations are accordingly similar, with the omission of the second step of the opening sequence.

A third embodiment of a container cap according to the invention is shown in FIGS. 6 to 8, in which the outlet orifice 9 is centrally positioned within a floor region 30 of a generally U-shaped cap 3. The floor region 30 is bounded at each end by an inclined wall region 31 which in turn adjoins an outer, steeper wall region 32 terminating in a cap peak 33 (FIGS. 6 and 8). A segmented flexible band 34 comprises five segments, each hinged to its adjacent segment or segments at hinges 35, 36, 37, 38, 39, and hinged to the cap peaks 33 through hinges 35, 40, each segment complementing a floor or wall region 30, 31, 32 of the cap 3, such that in the closed position (FIGS. 6 and 8) the flexible band 34 overlies and conforms to the said floor and wall regions 30, 31, 32. The flexible band 34 additionally comprises an arcuate portion 41 overlying the central segment 34*a* of the flexible band 34 and connected through hinges 42, 43 to the two segments on either side of the central segment 34*a*. The underside of the central segment 34*a* carries a plug 15 for snap-fit engagement with the orifice 9. The front face 44 of the cap 3 has a curved, generally U-shaped upper edge (FIGS. 6 and 7) slightly concealing the floor and wall regions 30, 31, 32, whereas the rear face 45 (FIG. 8) has an upper edge conforming to the floor and wall regions 30, 31, 32.

In the closed configuration (FIGS. 6 and 8), the segmented flexible oand 34 conforms to the floor and wall regions 30, 31, 32 with the plug 15 engaged in the orifice 9, and with only the arcuate portion 41 protruding. In order to uncover the outlet orifice 9 to open the container, the arcuate band 41, positioned as shown in FIGS. 6 and 8, is gripped between finger and thumb and pulled upwardly. This results in the band 34 pivoting about hinges 35, 36, 37, 38, 39 and 40, and simultaneously the arcuate band 41 pivoting about hinges 42 and 43, to reach the open configuration shown in FIG. 7. The open band 34 then constitutes a loop by which the container may be hung from a suitable support.

It will be appreciated that, during the course of the opening and closing movements the hinged segmented band 34 passes through a flatter configuration, intermediate between the configurations shown in FIGS. 6 and 7, and that there will be an inbuilt resistance to its passing through that position, and that on one side of that position the hinged segmented band will be biased toward the closed configuration, while on the other side of that position it will be biased toward the open loop configuration. As with the previous embodiments, the flexible band 34 remains in the same vertical plane throughout all configurations.

In a fourth embodiment of a container cap according to the invention, as shown in FIGS. 9 and 10, the cap 3 is provided with an internal wall 46 constituting an extension of an internal wall 47 within the container body 2, such that the container 1 is divided into two separate internal compartments by the internal wall 46, 47. In this embodiment, the cap 3 is externally similar to that shown in FIGS. 1 to 3, except that the channel 8*a* is identical to the channel 8 and has a second orifice 9*a* (FIG. 10), and the straight portion 19 (FIG. 3) of the flexible band 11 is replaced by a second closure portion 13*a* carrying a second plug 15*a* for snap-fit engagement into the second orifice 9*a* (FIG. 10). Additionally, the arcuate portion 11*a* of the flexible band 11 is provided with a second out-turned lip 12*a* and the container body 2 is provided with a second shallow recess 17*a*.

In the closed configuration this embodiment will appear substantially identical to the first embodiment, as shown in FIG. 1, apart from the presence of the second lip 12*a* and the second recess 17*a*. The opening and closing operations and functions are analogous to those of the first embodiment, except that the cap may be opened from either end, by lip 12 or by lip 12*a*. In use, it will generally be opened only to the intermediate open position, as shown in FIG. 9, so that one orifice is open while the other orifice remains closed, allowing separate access to the two internal compartments.

A twin-compartment container of this type is useful for containing two separate but complementary components. For example, it may be used to contain a shower gel or body shampoo in one compartment, with a hair shampoo in the second compartment; or a hair shampoo and a hair conditioner in the two separate compartments; or it may be used to contain the two components of a two-component glue.

The several embodiments described above have been described with the flexible band and the remainder of the cap being integrally formed in a 'one-piece' construction. This may in general be done by suitable moulding techniques. Alternatively, however, the flexible band and the remainder of the cap may be formed separately (for example by separate moulding) and be connected together by means of interlocking portions or by the use of adhesive.

For example, in the embodiments of FIGS. 1 to 3, and FIGS. 9 and 10, the channel floors 10, 10*a* may be constructed as part of the flexible band 11 and be inserted as a tight interlocking snap-fit between the sides of the respective end walls 4, 4*a* of the cap 3. Alternatively, one end of the flexible band 11 may be integrally moulded with the remainder of the cap 3, at one end only, such as at hinge 20 or at hinge 16, in the embodiment of FIGS. 1 to 3, with the other end of the flexible band 11 being connected to the remainder of the cap 3 by adhesive or interlocking snap-fit.

Likewise, in the embodiment of FIGS. 4 and 5, one end of the flexible band 11 may be moulded to the remainder of the cap 3 at hinge 21, while the other end is formed to constitute the floor 10 interlocked into the channel 8 between the two parts of the wall 4.

In the embodiment of FIGS. 6 to 8, the floor and wall regions 30, 31, 32 may be formed integrally with the band 34 and be interlocked into or glued onto the remainder of the cap 3. Alternatively, the band 34 may be integrally moulded with the remainder of the cap 3 at hinge 35, the other end of the band 34 being connected to an appropriate part of the remainder of the cap 3 by interlocking or by adhesive.

Many variations of connection between the cap and flexible band will be apparent to the skilled man without departing from the scope of the invention.

We claim:

1. A cap for a dispensing container for a liquid, the cap having an outlet orifice for the liquid and a removable closure for the outlet, the closure comprising a flexible band carrying a plug for sealing the outlet orifice, each end of the band being flexibly attached to the cap, and the band being constructed to form a hanging support for the container when the plug is removed from the orifice, and being arranged to lie in substantially the same plane both when the orifice is closed and when the orifice is open.

2. A cap according to claim 1, which contains two separate compartments, each communicable with a respective compartment in the container, and each provided with an outlet orifice, the flexible band carrying a plug for sealing each outlet orifice.

3. A cap according to claim 2, in which either plug is removaole from its respective orifice while the other orifice remains sealed by its plug.

4. A cap according to claim 3, in which the flexible band forms a hanging support for the container wnen only one plug is removed from its orifice.

5. A cap according to claim 1, in which each end of the flexible band is flexibly attached to the cap by means of a hinge or other pivot means.

6. A cap according to claim 5, in which the or each plug is formed on a portion of respective portion of the band which is hinged at each end of the said portion, at least one of the hinged ends of the said portion being located between the ends of the band attached to the cap.

7. A cap according to claim 6 in which the or each said plug-carrying portion of the band is concealed by another portion of the band when the outlet orifice or the respective outlet orifice is closed, and is revealed when the plug is removed from the said orifice.

8. A cap according to claim 7, in which one end of the or each plug-carrying portion is directly attached to the cap, while the other end is hingedly attached to the remainder of the band, the two ends of the or each plug-carrying portion being arranged to pivot about the respective ninge connections in the same angular direction at the same time.

9. A cap according to claim 1, in which a portion of the flexible band is arcuate.

10. A cap according to claim 9, in which the arcuate portion is resiliently deformable and is so arranged as to bias the flexible band toward the open position or toward the closed position on respective sides of an intermediate deformed position.

* * * * *